US011728101B2

(12) United States Patent
Delbaere et al.

(10) Patent No.: US 11,728,101 B2
(45) Date of Patent: Aug. 15, 2023

(54) METHODS FOR ESTIMATING A PROPERTY OF AN ELECTRICAL SWITCHING DEVICE, DEVICES FOR IMPLEMENTING THESE METHODS

(71) Applicant: Schneider Electric Industries SAS, Rueil Malmaison (FR)

(72) Inventors: Stéphane Delbaere, Meylan (FR); Rémy Orban, Saint Martin d'Uriage (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 81 days.

(21) Appl. No.: 17/376,285

(22) Filed: Jul. 15, 2021

(65) Prior Publication Data

US 2022/0020539 A1 Jan. 20, 2022

(30) Foreign Application Priority Data

Jul. 20, 2020 (FR) ..... 2007607

(51) Int. Cl.
*H01H 1/00* (2006.01)
*H01H 71/12* (2006.01)
(Continued)

(52) U.S. Cl.
CPC ..... *H01H 1/0015* (2013.01); *H01H 71/123* (2013.01); *H01H 2011/0068* (2013.01); *H01H 2071/044* (2013.01)

(58) Field of Classification Search
CPC ..... H01H 1/0015; H01H 71/123; H01H 2011/0068; H01H 2071/044; G01R 31/327
See application file for complete search history.

(56) References Cited

U.S. PATENT DOCUMENTS 7,557,583 B2 * 7/2009 Zettel ..... G01R 31/3278 324/421
2001/0019573 A1 * 9/2001 Dougherty ..... H01H 1/0015 324/424

(Continued)

FOREIGN PATENT DOCUMENTS

EP 1475813 A1 11/2004
EP 3340262 A1 6/2018

OTHER PUBLICATIONS

French Search Report and Written Opinion dated Mar. 15, 2021 for French Patent Application No. 2007607, 5 pages.

*Primary Examiner* — Alvaro E Fortich
*Assistant Examiner* — Zannatul Ferdous
(74) *Attorney, Agent, or Firm* — Locke Lord LLP

(57) ABSTRACT

A method for estimating a property of an electrical switching device includes: detecting a movement of electrical contacts of the switching device beyond an opening threshold; measuring, for at least one phase of the electrical device, the electric current through this phase; evaluating, for at least one phase of the electrical device, the voltage of an electric arc between the electrical contacts that are associated with this phase; and calculating, for at least the phase of the electrical device, an energy value associated with the electric arc, by numerically integrating the product of the measured electric current and of the evaluated voltage, the integration being performed over a time interval starting from the detection of the movement of the electrical contacts.

11 Claims, 5 Drawing Sheets

(51) Int. Cl.
*H01H 11/00* (2006.01)
*H01H 71/04* (2006.01)

(56) References Cited

U.S. PATENT DOCUMENTS

2004/0223276 A1 11/2004 Wimmer
2017/0062155 A1* 3/2017 Cary ..... H01H 33/14
2017/0170644 A1* 6/2017 Andrea ..... H01H 9/30

* cited by examiner

METHODS FOR ESTIMATING A PROPERTY OF AN ELECTRICAL SWITCHING DEVICE, DEVICES FOR IMPLEMENTING THESE METHODS

TECHNICAL FIELD

The present invention relates to methods for estimating a property of an electrical switching device, and to associated devices for implementing these methods.

More particularly, the invention relates to electrical contactors including an electromagnetic actuator comprising a coil.

BACKGROUND

Such electrical switching devices are configured for switching between an open state and a closed state, for example in order to control the power supply to an electrical load. Moving electrical contacts are usually connected to a moving part of the actuator which is moved by the action of a magnetic field created by the coil when a suitable electric current passes through it.

It is desirable to be able to estimate one or more properties of the device automatically when it is in operation, for example in order to discover its state and/or to detect the appearance of malfunctions and thus provide suitable preventive maintenance.

Some devices have dedicated sensors for measuring properties of the device such as the temperature or the state of wear of the electrical contacts. However, these sensors increase the production cost of the device. Moreover, it is not always possible to integrate a new sensor into an existing device.

SUMMARY

The invention is intended, more particularly, to overcome these drawbacks by proposing methods for estimating one or more properties of an electrical switching device.

To this end, one aspect of the invention relates to a method for estimating a property of an electrical switching device, notably an energy value of an electric arc during an opening phase of the device, this method including steps of:

- detecting a movement of electrical contacts of the switching device beyond an opening threshold;
- measuring, for at least one phase of the electrical device, the electric current through this phase;
- evaluating, for at least one phase of the electrical device, the voltage of an electric arc between the electrical contacts that are associated with this phase;
- calculating, for at least said phase of the electrical device, an energy value associated with the electric arc, by numerically integrating the product of the measured electric current and of the estimated voltage, the integration being performed over a time interval starting from the detection of the movement of the electrical contacts.

Because of the invention, it is easy to determine the energy level of the electric arc appearing at the electrical contacts when the latter are separated during opening. This determination is carried out in a simple manner during the operation of the device, solely on the basis of values found by electrical measurements and without the need for a dedicated sensor.

The information on the energy level of the electric arc may advantageously be used subsequently for estimating the state of wear of the electrical contacts.

According to some advantageous but non-mandatory aspects, such a method may incorporate one or more of the following features, taken alone or in any technically permissible combination:

- An anomaly condition is identified if the energy value exceeds a predefined threshold.
- The voltage is calculated on the basis of the following formula: $U=2(a+bx+c+dx/I)$ where I is the electric current measured for said phase of the electrical device, x is the movement of the electrical contacts of this phase of the electrical device, and a, b, c and d are numeric parameters.
- The time interval is ended on the expiry of a predefined period.
- The predefined period is equal to 50 ms or to 100 ms.
- The time interval is ended when the electric current measured for this electrical phase reaches a zero value.
- The switching device is a contact including an electromagnetic actuator.

According to another aspect, a method for estimating a state of wear of electrical contacts of an electrical switching device includes steps of:

- estimating an energy value associated with an electric arc appearing between electrical contacts of a phase of the device during an opening phase of the contacts, by means of a method according to the invention;
- calculating a value representative of a state of wear of the electrical contacts associated with this electrical phase, this calculation being carried out iteratively by incrementing a preceding value with a quantity depending on the calculated energy value.

According to another aspect, the electric current and voltage between electrical contacts are measured for each phase of the electrical device, wherein only the electrical phase for which opening is detected as taking place first is taken into account in the calculation of the wear.

According to another aspect, an electrical switching device includes an electronic control device for estimating a property of the electrical switching device, notably an energy value of an electric arc during an opening phase of the device, the electronic control device being configured for:

- detecting a movement of electrical contacts of the switching device beyond an opening threshold;
- measuring, for at least one phase of the electrical device, the electric current in this phase;
- evaluating, for at least one phase of the electrical device, the voltage of an electric arc between the electrical contacts that are associated with this phase;
- calculating, for at least said phase of the electrical device, an energy value associated with the electric arc, by numerically integrating the product of the measured electric current and of the evaluated voltage, the integration being performed over a time interval starting from the detection of the movement of the electrical contacts.

BRIEF DESCRIPTION OF THE DRAWINGS

The invention will be clarified and other advantages of the invention will be more clearly revealed by the following description of an embodiment of a method, provided solely by way of example, with reference to the attached drawings, in which.

DETAILED DESCRIPTION

Figure 1:
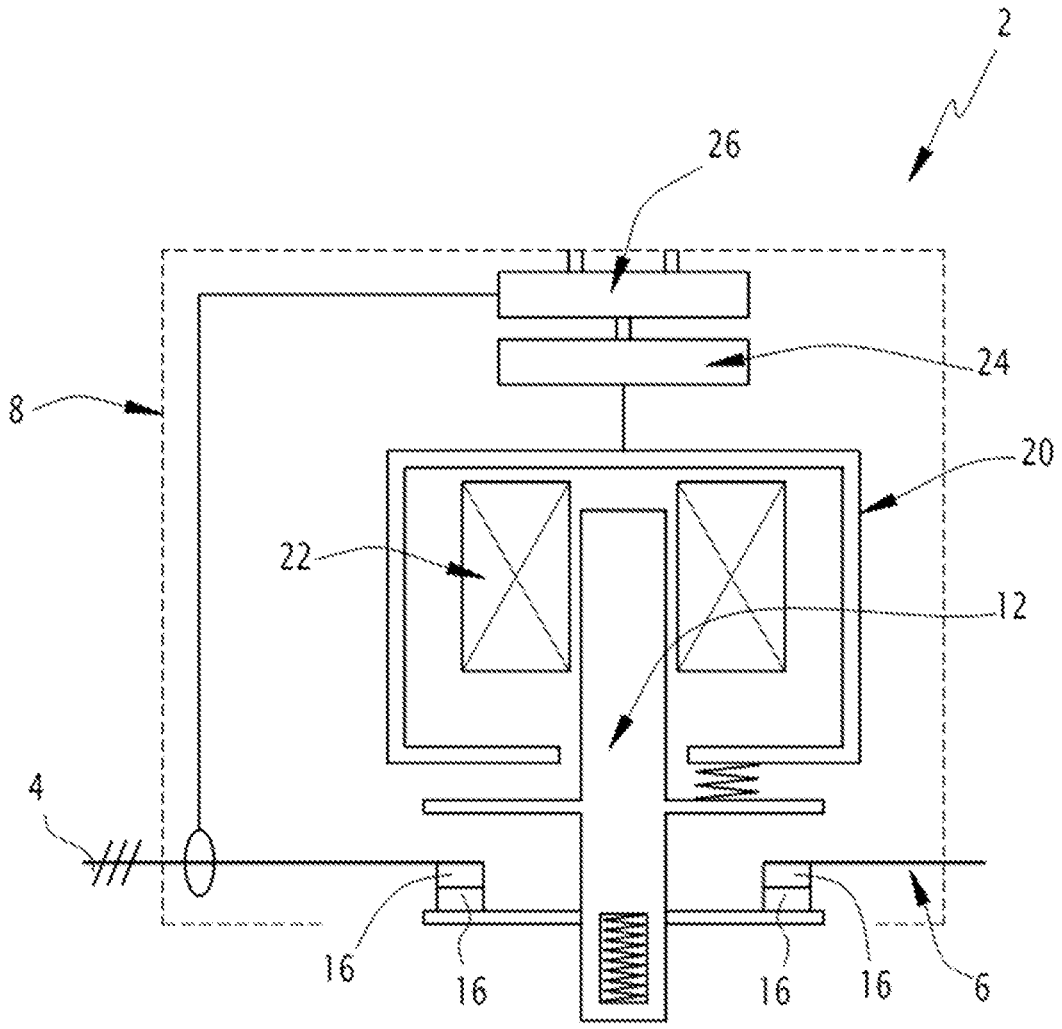
FIG. 1 is a schematic view of an electrical switching device including an electromagnetic actuator according to embodiments of the invention.

FIG. 1 shows an electrical switching device 2 such as a contactor.

The device 2 is configured to be switched between a closed state in which it allows the electric current to flow and an open state in which it prevents the flow of an electric current.

For example, the device 2 may be installed in an electrical installation to control the power supply provided to an electrical load, such as a motor, by an electrical energy source. The energy source is, for example, a power supply network or a generator.

In the illustrated example, the device 2 is connected to an upstream electrical line 4 on the one hand, and to a downstream electrical line 6 on the other hand.

The electrical lines 4 and 6 may include a plurality of electrical phases, for example in order to carry a three-phase alternating electric current. Regardless of the number of phases, the device 2 is configured to interrupt, or alternatively allow, the flow of an electric current in each of the phases. However, in order to simplify FIG. 1, only one electrical phase conductor is shown for each of the electrical lines 4 and 6.

The device 2 includes, for example, a casing 8.

For each electrical phase, the device 2 comprises separable contacts 10, arranged on a moving part 12, and fixed contacts 14, connected to the electrical lines upstream 4 and downstream 6. Each of the contacts 10 and 14 comprises contact pads 16, which in this case are made of metal, preferably silver alloy or any equivalent material.

The moving part 12 of the device 2 is movable between a closed position, in which the moving contacts 10 are in contact with the fixed contacts 14, and an open position, shown in FIG. 1, in which the moving contacts 10 are separated from the fixed contacts 14.

The device 2 also includes an electromagnetic actuator 20 configured for moving the moving part 12 between the closed position and the open position.

The electromagnetic actuator 20 includes a coil 22 configured for generating a magnetic field when it is supplied with an electric control current, in order to move the moving part 12.

For example, the coil 22 includes a winding of electrically conductive wire. The moving part 12 may be mounted integrally with a magnetic core which is arranged coaxially with the coil 22 and which is moved by the action of the magnetic field generated by the coil 22 when the latter is energized by the input of an appropriate electric current.

The device 2 further includes a power supply circuit 24, configured for supplying power to the coil 12, and an electronic control device 26, configured for controlling the power supply circuit 24.

In numerous embodiments, the device 2 comprises an input interface, including control electrodes for example, which is configured for receiving opening or closing commands from a user. For example, a control voltage may be applied between the control electrodes.

In numerous embodiments, the device 2 further comprises a current sensor 28 configured for measuring a current flowing in each of the phases of the upstream line 4.

Figure 2:
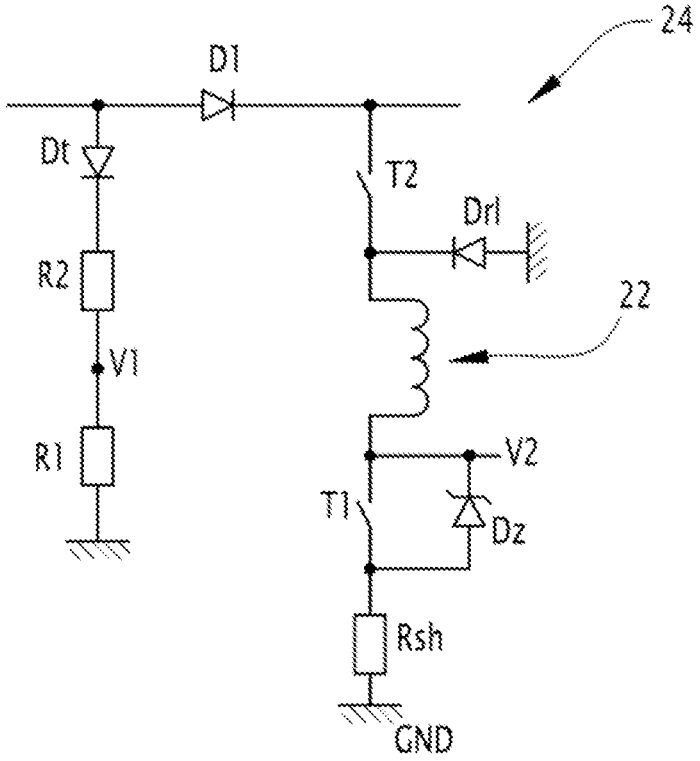
FIG. 2 is a schematic view of an example of the control circuit of the electromagnetic actuator of the switching device of FIG. 1.

FIG. 2 shows an embodiment of the power supply circuit 24.

In the illustrated example, the power supply circuit 24 includes a power supply bus Vc adapted to be supplied with power either by an external power supply or by the control signal received by the device 2.

Preferably, the power supply circuit 24 comprises a measurement device configured for measuring the value of the voltage between the power supply bus Vc and an electrical ground GND of the circuit 24.

For example, the measurement device comprises two resistors R1 and R2 connected in series with a diode Dt between the power supply bus Vc and the electrical ground GND. A first measurement point, placed between the resistors R1 and R2 in this case, may be used to collect a first measurement voltage V1 representative of the voltage present between the power supply bus Vc and the electrical ground GND.

The power supply circuit 24 also includes one or more power switches connected to the coil 22 for selectively connecting or disconnecting the coil 22 to or from the power supply bus Vc and the ground GND.

For example, a first switch T1 is connected between the coil 22 and the ground GND. A second switch T2 is connected between the coil 22 and the power supply bus Vc.

For example, when the two switches T1 and T2 are closed, a voltage depending on the voltage Vc is applied to the terminals of the coil 22, and an energizing current flows in the coil 22. When only the second switch T2 is open, the coil 22 can be discharged and a residual electric current can continue to flow temporarily in the coil 22.

The switches T1 and T2 are, for example, controlled by the electronic control device 26. According to examples of embodiment, the switches T1 and T2 are semiconductor-type power switches such as Mosfet transistors, thyristors, insulated-gate bipolar transistors (IGBT), or any other equivalent devices.

In the illustrated example, a diode Drl, called a freewheeling diode, is connected between the second switch T2 and the ground GND. A Zener diode Dz may be connected in parallel with the first switch T1. A diode D1 may be placed on the power supply bus Vc between the second switch T2 and the measurement device in order to prevent any current return towards the latter.

In numerous embodiments, a resistor Rsh is connected in series with the first switch T1 to collect a second measurement voltage V2 representative of the electric current flowing in the coil 22.

The architecture of the power supply circuit 24 is not limiting, and there are other possible implementations.

As a general rule, the electronic control device 26 is configured for causing the device 2 to switch when it receives an appropriate control command.

Advantageously, the electronic control device 26 is also configured for estimating at least one property of the device 2 during the operation of the device 2, and notably one or more properties of the coil 22, such as the resistance of the coil 22, the inductance of the coil 22 and the temperature of the coil 22, as will be more readily apparent from a perusal of the following text.

In numerous embodiments, the electronic control device 26 is implemented by one or more electronic circuits.

For example, the electronic control device 26 includes a processor such as a programmable microcontroller or a microprocessor, and a computer memory or any medium for recording computer-readable data.

According to examples, the memory is a ROM or a RAM or a non-volatile memory of the EPROM or Flash or equivalent type. The memory includes executable instructions and/or computer code for causing the control device 26 to operate in accordance with one or more of the embodiments described below when executed by the processor.

According to variants, the electronic control device 26 may include a signal processing processor (DSP), or a reprogrammable logic component (FPGA), or an application-specific integrated circuit (ASIC), or any equivalent element.

Figure 3:
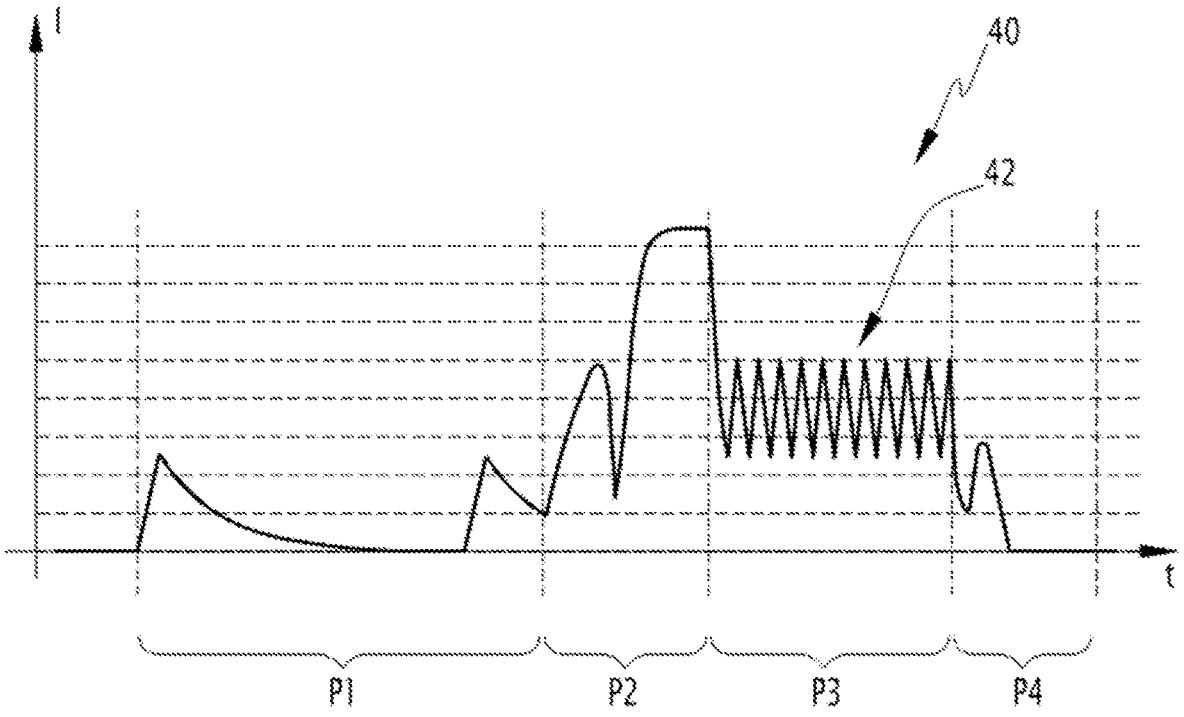
FIG. 3 is a graph representing the variation of an electric control current of the electromagnetic actuator of FIG. 2 in a number of operating phases.

FIG. 3 shows a graph 40 illustrating the variation of the electric current (I) flowing in the coil 22 during the time (t) in different successive operating phases of the device 2, denoted P1, P2, P3 and P4, in the case where the device 2 is switched to the closed state and then switched again to the open state. This electric current is referred to as the "coil current" in the following text.

The first phase P1 is an initial phase during which the device 2 is stably in the open state. In practice, the second switch T2 remains open and the coil current remains at zero.

Optionally, as seen in the figure, current pulses may be injected into the coil 22 for the estimation of said properties.

The second phase P2 is a closing phase, after a closing command has been received by the device 2. For example, the switches T1 and T2 are closed. The coil current increases until it reaches a threshold above which the moving part 12 starts to move from its open position to its closed position. In the rest of the closing phase, the coil current increases to a plateau value when the moving contacts 14 come to bear on the fixed contacts 10. The device 2 is then in the closed state.

In a third phase P3, called the holding phase, the coil current continues to be held above the threshold value. In practice, the coil current may, during this holding phase, remain below the plateau value reached in the closing phase.

Optionally, as seen in the figure, the coil voltage may be varied periodically so as to reduce the coil current as far as possible while holding it above said threshold, in order to avoid unnecessary energy losses.

In the illustrated example, the periodic variation of the coil voltage is obtained by opening and closing the second switch T2 alternately at a predefined chopping frequency, thus creating oscillations of the coil voltage according to a predefined profile. Consequently, the coil current also has oscillations 42 between two values of strength. During this time, the first switch T1 may remain closed.

To prevent the mechanical vibrations caused by these oscillations from generating a noise perceptible to the human ear, the chopping frequency is advantageously chosen to be below 100 Hz or above 25 kHz. In the illustrated example, the chopping frequency is below 100 Hz.

The opening phase P4 starts when the electronic control device 26 receives an opening command. The switches T1 and T2 are both opened.

An example of the operation of a method for estimating properties of the device 2 will now be described with reference to FIGS. 4 and 5. For example, this is method is executed by the control device 26.

This method is more particularly applicable to the opening phase P4 described above, for estimating the quantity of energy released by an electric arc appearing between the contact pads 16 when the contacts 10 and 14 are separated from each other.

More generally, this method includes steps of:

- detecting a movement of the electrical contacts 10, 14 beyond an opening threshold (step 100);
- measuring, for at least one phase of the electrical device, the electric current in this phase (step 102), that is to say the current flowing between the electrical contacts associated with this phase;
- evaluating, for at least one phase of the electrical device, the voltage of an electric arc between the electrical contacts that are associated with this phase (step 104);
- calculating, for at least said phase of the electrical device, an energy value associated with the electric arc, by numerically integrating the product of the measured electric current and of the evaluated voltage, the integration being performed over a time interval starting from the detection of the movement of the electrical contacts (step 106).

However, as a variant, the steps could be executed in a different order. Some steps might be omitted. The described example does not prevent, in other embodiments, other steps from being implemented conjointly and/or sequentially with the described steps.

Figure 4:
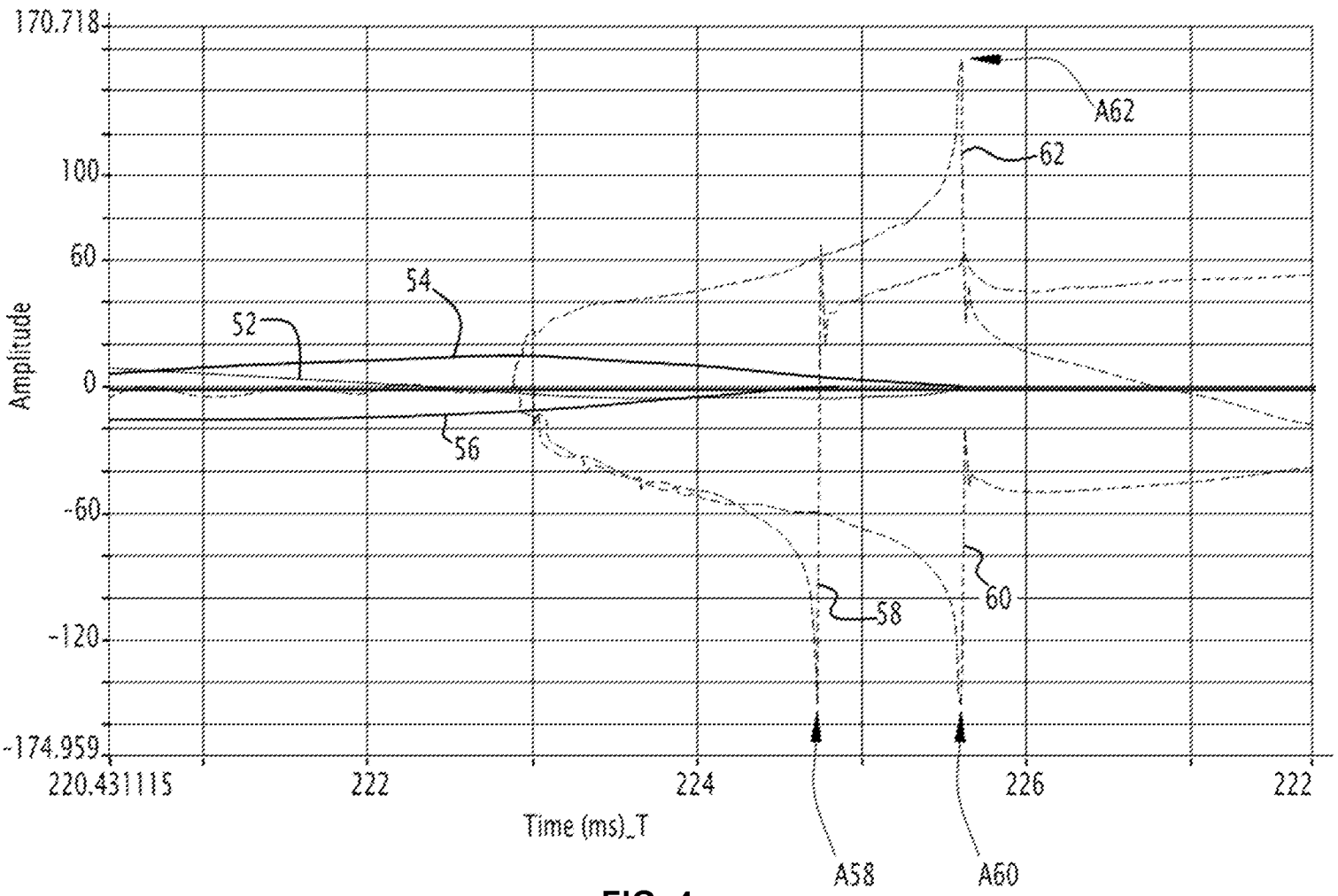
FIG. 4 shows the variation, as a function of time, for a three-phase switching device according to embodiments, of the electric currents of each phase and of the voltages between upstream and downstream phase conductors for each electrical phase connected to the switching device.
Figure 5:
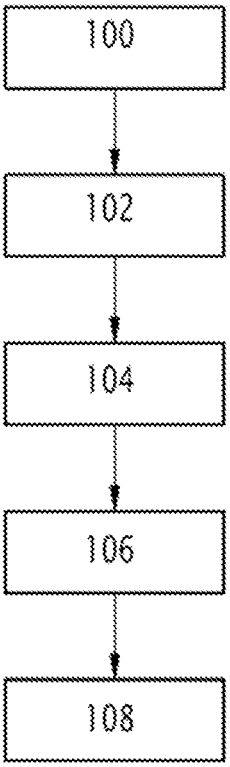
FIG. 5 is an example of a method according to embodiments of the invention.

FIG. 4 shows the variation, as a function of time (horizontal axis), for a three-phase switching device 2 according to embodiments, of the electric currents of each phase (curves 52, 54, 56, also called phase currents) and of the voltages between the fixed and moving contacts 10, 14 for each phase (curves 58, 60 and 62 respectively).

In the illustrated example, the current curves 52, 54 and 56 have a sinusoidal shape and are phase-shifted from each other. To interrupt the current, the device 2 is switched to the open state around the instant t=223 ms. From this instant onwards, for each phase, the voltage between the contact pads 16 increases as the moving contact 14 moves away from the fixed contact 10, this voltage indicating the presence of an electric arc between these pads 16.

If required, the electric arc is interrupted for each phase when the contacts are sufficiently far apart and the electric phase current (which is usually periodic with a sinusoidal shape) passes through zero. Alternatively, the electric arc may be extinguished when it moves towards an arc extinction chamber of the device 2.

The extinction of the electric arc is indicated by the presence of a voltage peak (denoted A58, A60 and A62 for the curves 58, 60 and 62 respectively). In the illustrated example, for each phase, after the appearance of the voltage peak, the voltage decreases until it is equal to the network voltage, which in this case is delivered by the energy source of the electrical installation.

The method described above may be started when the device 2 is in the closed state (in the operating phase P3 described above, for example), after the device 2 has received an opening command, for example.

In numerous embodiments, the current measurement and voltage measurement may be repeated over time, preferably periodically.

For example, each sampling of a value of the voltage is carried out simultaneously with the sampling of a value of the electric current.

The current measurements may be made with the current sensor 28.

The current measurement and/or the voltage measurement may also be started before step 100, for example as soon as the device 2 is put into operation.

Advantageously, in the calculation step 104, the voltage U between the contact 10 and 14 of each electrical phase (or pole) of the device 2 (or, more precisely, the voltage between the respective contact pads 16 of the contacts 10 and 14) is calculated using the following formula:

$$U = 2\left(a + bx + \frac{c + dx}{I}\right)$$

where:

I is the electric current measured for said phase of the electrical device, x is the movement of the electrical contacts of this phase of the electrical device, and a, b, c and d are numeric parameters, defined for example as a function of properties of the construction of the device 2 and/or the actuator.

By way of example, as a first approximation, the voltage U of the arc may be estimated as equal to the sum of the cathode and anode voltage drops (each of the order of fifteen volts), to which is added an additional voltage value proportional to the movement x of the moving part 12. This additional voltage value corresponds to the voltage due to the elongation of the arc, typically estimated to be equal to about 3V/mm. In the present case of dual cut-out switching, the voltage U may be between 30 V and 50 V.

This formula enables the electric arc voltage to be estimated with a high degree of accuracy. However, other formulae may be used to calculate this voltage.

For example, the movement x is defined as a variation of the position of a moving part of the actuator 20 relative to a fixed part of the actuator, such as the coil 22, this moving part being configured to move in translation relative to the coil 22 along an axis of movement. The moving part may be a moving board carrying the moving contact or contacts 14 associated with each electrical phase. In practice, the moving contacts 14 of all the poles of the device 2 move simultaneously.

Preferably, this movement x is calculated on the basis of estimates of the position of the moving contacts 14 (or of the moving part, in this case).

For example, this position may be determined with a dedicated position sensor, or, preferably, it may be estimated on the basis of measurements of electrical quantities.

According to a possible example, the position may be estimated on the basis of a method including the following steps, which may be implemented by the control device 26:

a) after receiving an opening command, causing the electromagnetic actuator 20 to open, for example by injecting an energizing current into the coil 22;

b) during the switching of the device 2 to the open state, measuring and recording the voltage values at the terminals of the coil ($U_{BOB}$) and the current flowing through the coil ($I_{BOB}$);

c) calculating values of a magnetic flux (ϕ) passing through the coil 22, by integration of the recorded values of the coil current, the coil voltage and the values of resistance ($R_{BOB}$) and inductance ($L_{BOB}$) of the coil, these resistance and inductance values being known in advance, and possibly having been pre-recorded in the control device 26, for example;

d) on the basis of the values of magnetic flux (ϕ) and coil current ($I_{BOB}$), evaluating and recording positions (x) of a core of the electromagnetic actuator 20 on the basis of a table of characteristic data for the electromagnetic actuator, the data table having been recorded previously in the control device 26 and defining a one-to-one relation between the position (x) of the core, the magnetic flux (ϕ) and the coil current ($I_{BOB}$).

For example, the core forms part of the moving part 12 of the device 2.

In the preceding text, the coil current $I_{BOB}$ is defined as an energizing current flowing through the coil.

A tripping current $I_D$ is defined as a threshold of the coil current $I_{BOB}$ which, when the actuator 1 is in the open state, enables the actuator 1 to move to the closed state, as soon as the coil current $I_{BOB}$ rises above the tripping current $I_D$.

A stall current $I_S$ is defined as a threshold of the coil current $I_{BOB}$ which, when the actuator 1 is in the closed state, enables the actuator 1 to move to the open state, as soon as the coil current $I_{BOB}$ falls below the stall current $I_S$.

For example, the value of the magnetic flux ϕ is related to the values of coil voltage $U_{BOB}$ and coil current $I_{BOB}$ by the following equation, denoted Math 1 below:

$$U_{BOB} = R_{BOB} \cdot I_{BOB} + N\frac{d\phi}{dt} \qquad \text{[Math 1]}$$

in which N is the number of turns of the coil 22 and ϕ is the magnetic flux passing through each turn of the coil 22.

By deriving ϕ in the equation Math 1, we obtain a general equation Math 2 governing the electromagnetic quantities in the actuator 1:

$$U_{BOB} = R_{BOB} \cdot I_{BOB} + N\frac{d\phi}{dI_{BOB}}\frac{dI_{BOB}}{dt} + N\frac{d\phi}{dx}\frac{dx}{dt} + N\frac{d\phi}{di_f}\frac{di_f}{dt} \qquad \text{[Math 2]}$$

in which the last term $$N\frac{d\phi}{di_f}\frac{di_f}{dt}$$

causes the intervention of induction currents, also called eddy currents, denoted $i_f$.

Disregarding the induced currents, the magnetic circuit has a reluctance Rel which is, on the one hand, a function of the position x of the moving core (of the moving part 12) and of the coil current $I_{BOB}$, and which is, on the other hand, linked to the magnetic flux ϕ and to the coil current $I_{BOB}$ by the following relation $Rel(x, I_{BOB})\cdot\phi = N\cdot I_{BOB}$.

In other words, the magnetic flux ϕ is a function of the position x and of the coil current $I_{BOB}$, the magnetic flux ϕ being expressible in the form of an analytic relation, or, for greater accuracy, by a two-dimensional response surface generated by tools for simulating the magnetic circuit of the device 2.

In the great majority of cases, the surface $\phi = f(x, I_{BOB})$ is of the one-to-one type; in other words, for a given coil current $I_{BOB}$, a given data value of the position x corresponds to a unique value of magnetic flux $\phi$. This makes it possible to reconstruct an inverse function $x=g(\phi, I_{BOB})$ the value of the position x as a function of the magnetic flux $\phi$ and of the coil current $I_{BOB}$.

The surface $\phi=f(x, I_{BOB})$, or its inverse function $x=g(\phi, I_{BOB})$, is recorded in the memory of the control device 26, for example in the form of a table of characteristic data of the electromagnetic actuator, the data table defining a one-to-one relation between the position (x) of the core, the coil flux ($\phi$) and the coil current ($I_{BOB}$).

The magnetic flux $\phi$ is also given by the integration with respect to time of the equation Math 1. This results in the equation Math 3 below:

$$\phi(t) = \int \frac{U_{BOB} - R_{BOB} \cdot I_{BOB}}{N} \cdot dt + \phi_0 \quad \text{[Math 3]}$$

in which $U_{BOB}$ and $I_{BOB}$ are measured, N, dt and $R_{BOB}$ are known, and $\phi_0$ is an initial value of the magnetic flux $\phi$, at the start of the integration interval. In the context of the present invention, the integration interval preferably begins at the moment when the control device 26 commands the opening of the actuator, that is to say at the instant $t_2'$.

The magnetic flux $\phi$ may be calculated using the equation Math 3, by numerical calculation methods implemented by the electronic control device 40.

The briefer the integration time interval dt, in other words the shorter the integration step, the smaller the calculation error will be. The interval dt is, for example, proportional to the inverse of a clock frequency of the calculation logic unit of the electronic control device 40. According to examples, the clock frequency of the device 40 is 1 kHz.

In order to calculate the flux $\phi$ by integration of the measurements of $U_{BOB}$ and $I_{BOB}$, and in order to use the inverse function $x=g(\phi,I_{BOB})$ to determine the variation of the position x of the moving core, the initial flux $\phi_0$ must be determined. An estimate of the initial flux $\hat{\phi}_0$ is defined.

One method of achieving this, called the autocorrection method, is based on the fact that the moving core remains stationary in the closed position during the opening phase P4 as long as the coil current $I_{BOB}$ is greater than the stall current $I_S$, that is to say before the instant $t_2''$ of stall, as long as the core is stationary in the closed position.

In other words, at each instant t between $t_2'$ and $t_2''$ (where $t_2'$ is the instant when the device 26 commands the opening of the device 2), as long as the coil current $I_{BOB}$ is greater than the stall current $I_S$, when the magnetic flux $\phi$ is calculated using the equation Math 3 and the position x at the instant t is deduced therefrom using the inverse function $x=g(\phi, I_{BOB})$, if the calculated position is not constant, in other words $x(t)\neq x(t_2')$, then there is an error in the estimate of the initial flux $\hat{\phi}_0$.

The magnetic flux $\phi$ at the instant t is then compensated to correct this error, this compensation taking the form of a re-estimation of the initial flux $\hat{\phi}_0$. The correction of the flux $\phi$ is applied several times, during a number of successive calculations and as long as the instant t between $t_2'$ and $t_2''$, until there is a convergence of the estimate of initial flux $\hat{\phi}_0$ and the actual flux $\phi_0$. As a result of the autocorrection method, the error in the initial flux $\phi_0$ is precisely compensated.

Thus, when the coil current $I_{BOB}$ decreases below the stall current $I_S$ and the core starts to move, the exact knowledge of the magnetic flux $\phi$ enables the position x to be calculated accurately.

In a variant, the position could be estimated in a different way.

Thus, at the end of step 104, an estimate of the movement x, or, in an equivalent manner, the position of the electrical contacts, is provided.

In step 106, the integration is performed over a time interval starting from the detection of the movement of the electrical contacts.

Preferably, the interval starts when the movement has reached a stand-by value at the flattening, but without the movable electrical contacts 14 being separated from the fixed contacts 10.

In practice, the time interval ends when the electric arc is extinguished, or when the electric arc has moved towards an arc extinction chamber of the device 2.

Advantageously, said time interval is ended on the expiry of a predefined period. For example, the predefined period is equal to 50 ms or to 100 ms.

These values ensure that the electric arc will be extinguished on the expiry of the predefined period in most situations.

For example, the predefined period may be at least five times the half-period of the phase current, the device 2 being configured to interrupt the current after two or three half-periods of the phase current.

In alternative embodiments, said time interval ends when the electric current measured for this electrical phase reaches a zero value, for example when the current sensor 28 detects a current remaining permanently at zero in the corresponding phase.

Advantageously, the method described above may be used to estimate a state of wear of the electrical contacts 10, 14 of the device 2, or more particularly the state of wear of the contact pads 16.

This is because, in practice, the electric arc gradually damages the contact pads 16 by removal of material on each opening of the contacts 10 and 14. In some cases, the contact pads 16 may be damaged to the point of harming the correct operation of the device 2, for example because they have changed shape or their thickness has decreased to the point of no longer providing a good-quality electrical contact in the closed state.

Preferably, the estimation of the state of wear of the electrical contacts 10, 14 is based on the energy value.

Thus, in some embodiments, in a step 108, after step 106, a value representative of a state of wear of the electrical contacts 14 associated with this electrical phase is automatically calculated. Preferably, this calculation is carried out iteratively by incrementing a preceding value with a quantity depending on the calculated energy value in step 106.

Preferably, a value representative of a state of wear is defined for each of the phases of the device 2. Each of these values is incremented when the contacts are opened, with the estimated arc energy value for the corresponding electrical phase.

For example, this value representative of a state of wear is recorded, preferably for each of the electrical phases, in a memory of the control device 24. An initial value of the value representative of a state of wear may be pre-recorded in memory, in the factory for example.

Thus the state of wear of the electrical contacts 10, 14 is updated whenever the device 2 is switched to the open state.

If the cumulative value of at least one of the phases exceeds a pre-recorded alert threshold, an anomaly condition is automatically identified.

For example, a warning message may be sent to a remote user and/or may be displayed on a display screen of the device 2 or by means of an indicator lamp of the device 2.

In this way, any wear of the device 2 may be easily detected. The performance of preventive maintenance operations is therefore facilitated.

Optionally, the electric current and voltage between electrical contacts are measured for each phase of the electrical device, and only the electrical phase for which opening is detected as taking place first is taken into account in the calculation of the wear.

This enables an operator to intervene more rapidly as soon as significant wear appears on at least one of the poles, without waiting for the total degradation of the other poles. In fact, in some electrical installations and/or in some circumstances, the electric arc may appear first on a specific phase, before electric arcs appear on the other phases, owing to the phase-shifting of the currents between the phases, notably. Some poles therefore become worn more rapidly than others.

Advantageously, an anomaly condition may also be identified if the energy value estimated for an electrical phase of the device 2 in step 106 exceeds a predefined threshold. This makes it possible to detect a situation in which the electric arc would give off so much energy during switching to the open state that the contact pads 16 would be damaged.

Any feature of one of the embodiments or variants described above may be implemented in the other described embodiments and variants.

The invention claimed is:

1. A method for estimating an energy value of an electric arc during an opening phase of an electrical switching device, the method comprising:

detecting a movement of electrical contacts of the switching device beyond an opening threshold;

measuring, for at least one electrical phase of the electrical device, the electric current through the at least one electrical phase;

evaluating, for the at least one electrical phase of the electrical device, the voltage of an electric arc between the electrical contacts that are associated with the at least one electrical phase;

calculating, for at least said at least one electrical phase of the electrical device, an energy value associated with the electric arc, by numerically integrating a product of the measured electric current and of the evaluated voltage, the integration being performed over a time interval starting from the detection of the movement of the electrical contacts;

determining that the energy value exceeds a predefined threshold; and when the predefined threshold has been exceeded, automatically identifying an anomaly condition by means of a warning device, thereby facilitating preventative maintenance operations to be performed on the electrical contacts, wherein evaluating the voltage of the electric arc comprises calculating the voltage on the basis of the following formula: $U=2\ (a+bx+(c+dx)/I$ where I is the electric current measured for said at least one electrical phase, x is the movement of the electrical contacts of said at least one electrical phase, and a, b, c and d are numeric parameters.

2. The method according to claim 1, wherein an anomaly condition is identified if the energy value exceeds the predefined threshold.

3. The method according to claim 1, wherein said time interval is ended on an expiry of a predefined period.

4. The method according to claim 3, wherein the predefined period is equal to 50 ms or to 100 ms.

5. The method according to claim 1, wherein said time interval is ended when the electric current measured for said at least one electrical phase reaches a zero value.

6. The method according to claim 1, wherein the switching device is a contactor including an electromagnetic actuator.

7. The method according to claim 1, wherein the electrical switching device further comprises an actuator comprising a coil, and wherein the movement x of the electrical contacts is based on estimates of a position of the electrical contacts that are based on current through the coil and magnetic flux of the coil.

8. A method for estimating a state of wear of electrical contacts of an electrical switching device, comprising:

detecting a movement of electrical contacts of the switching device beyond an opening threshold;

measuring, for at least one electrical phase of the electrical device, the electric current through the at least one electrical phase:

evaluating, for the at least one electrical phase of the electrical device, the voltage of an electric arc between the electrical contacts that are associated with the at least one electrical phase;

calculating, for at least said at least one electrical phase of the electrical device, an energy value associated with the electric arc, by numerically integrating a product of the measured electric current and of the evaluated voltage, the integration being performed over a time interval starting from the detection of the movement of the electrical contacts;

calculating a value representative of a state of wear of the electrical contacts associated with said at least one electrical phase, the calculation of said value representative of the state of wear being carried out iteratively by incrementing a preceding value with a quantity depending on the calculated energy value;

determining that the value representative of the state of wear exceeds a predefined threshold; and when the predefined threshold has been exceeded, automatically identifying an anomaly condition by means of a warning device, thereby facilitating preventative maintenance operations to be performed on the electrical contacts, wherein evaluating the voltage of the electric arc comprises calculating the voltage on the basis of the following formula: $U=2\ (a+bx+(c+dx)/I)$ where I is the electric current measured for said at least one electrical phase, x is the movement of the electrical contacts of said at least one electrical phase, and a, b, c and d are numeric parameters.

9. The method according to claim 8, wherein the electric current and voltage between electrical contacts are measured for each phase of the electrical device, and wherein only an electrical phase for which opening is detected as taking place first is taken into account in the calculation of the wear.

10. An electrical switching device, comprising an electronic control device for estimating an energy value of an electric arc during an opening phase of the electrical switching device, the electronic control device being configured for:

detecting a movement of electrical contacts of the switching device beyond an opening threshold;

measuring, for at least one electrical phase of the electrical device, the electric current through the at least one electrical phase;

evaluating, for the at least one electrical phase of the electrical device, the voltage of an electric arc between the electrical contacts that are associated with the at least one electrical phase;

calculating, for at least said at least one electrical phase of the electrical device, an energy value associated with the electric arc, by numerically integrating a product of the measured electric current and of the evaluated voltage, the integration being performed over a time interval starting from the detection of the movement of the electrical contacts;

determining that the energy value exceeds a predefined threshold; and when the predefined threshold has been exceeded, automatically identifying an anomaly condition by means of a warning device, thereby facilitating preventative maintenance operations to be performed on the electrical contacts, wherein evaluating the voltage of the electric arc comprises calculating the voltage on the basis of the following formula: $U=2(a+bx+(c+dx)/I)$ where I is the electric current measured for said at least one electrical phase, x is the movement of the electrical contacts of said at least one electrical phase, and a, b, c and d are numeric parameters.

11. The system according to claim 10, wherein the electrical switching device further comprises an actuator comprising a coil, and wherein the movement x of the electrical contacts is based on estimates of a position of the electrical contacts that are based on current through the coil and magnetic flux of the coil.

* * * * *